US005165184A

United States Patent [19]

Gardaz et al.

[11] Patent Number: 5,165,184

[45] Date of Patent: Nov. 24, 1992

[54] IRONING DEVICE SOLE-PLATE WITH COATED RIBS

[75] Inventors: Claudine Gardaz, Rumilly; Jean-Pierre Buffard, Tresserve, both of France

[73] Assignee: SEB S.A., Selongey, France

[21] Appl. No.: 699,923

[22] Filed: May 14, 1991

[30] Foreign Application Priority Data

May 18, 1990 [FR] France ..... 90 06257

[51] Int. Cl.[5] ..... D06F 75/38

[52] U.S. Cl. ..... 38/93

[58] Field of Search ..... 38/16, 74, 77.3, 77.5, 38/88, 93, 97

[56] References Cited

U.S. PATENT DOCUMENTS

| | | | |
|---|---|---|---|
| 2,270,316 | 1/1942 | Kuhn et al. | 38/93 |
| 2,764,825 | 10/1956 | Coyne | 38/93 |
| 3,211,325 | 10/1965 | Wisnicki | 38/97 X |
| 3,238,650 | 3/1966 | Mullen | 38/93 |
| 3,480,461 | 11/1969 | Lynge | 38/93 X |
| 4,089,128 | 5/1978 | Baumgartner et al. | 38/93 |
| 4,665,637 | 5/1987 | Kramer | 38/93 |
| 4,800,661 | 1/1989 | Yamamoto et al. | 38/93 |

FOREIGN PATENT DOCUMENTS

| | | | |
|---|---|---|---|
| 0200647 | 11/1986 | European Pat. Off. . | |
| 0206121 | 12/1986 | European Pat. Off. . | |
| 0658647 | 3/1936 | Fed. Rep. of Germany | 38/93 |
| 2641553 | 7/1990 | France . | |
| 0150799 | 8/1985 | Japan | 38/93 |
| 2270200 | 11/1987 | Japan | 38/93 |
| 63-71300 | 3/1988 | Japan | 38/93 |

*Primary Examiner*—Werner H. Schroeder
*Assistant Examiner*—Ismael Izaguirre
*Attorney, Agent, or Firm*—Young & Thompson

[57] ABSTRACT

A smoothing or pressing or steam iron having a metallic sole-plate that comes into contact with articles to be ironed and has a series of substantially parallel ribs (6, 7) whose width and height are within the range of a few tenths of a millimeter to a few millimeters. The sole-plate has an exposed surface having a continuous anti-adhesive coating (8) selected from the group consisting of fluorocarbon resin and enamel. The coating follows the profile of the ribs. The ribs extend in a longitudinal direction of the sole-plate. Each rib has either a rounded crest or a pointed crest.

4 Claims, 1 Drawing Sheet

FIG_1
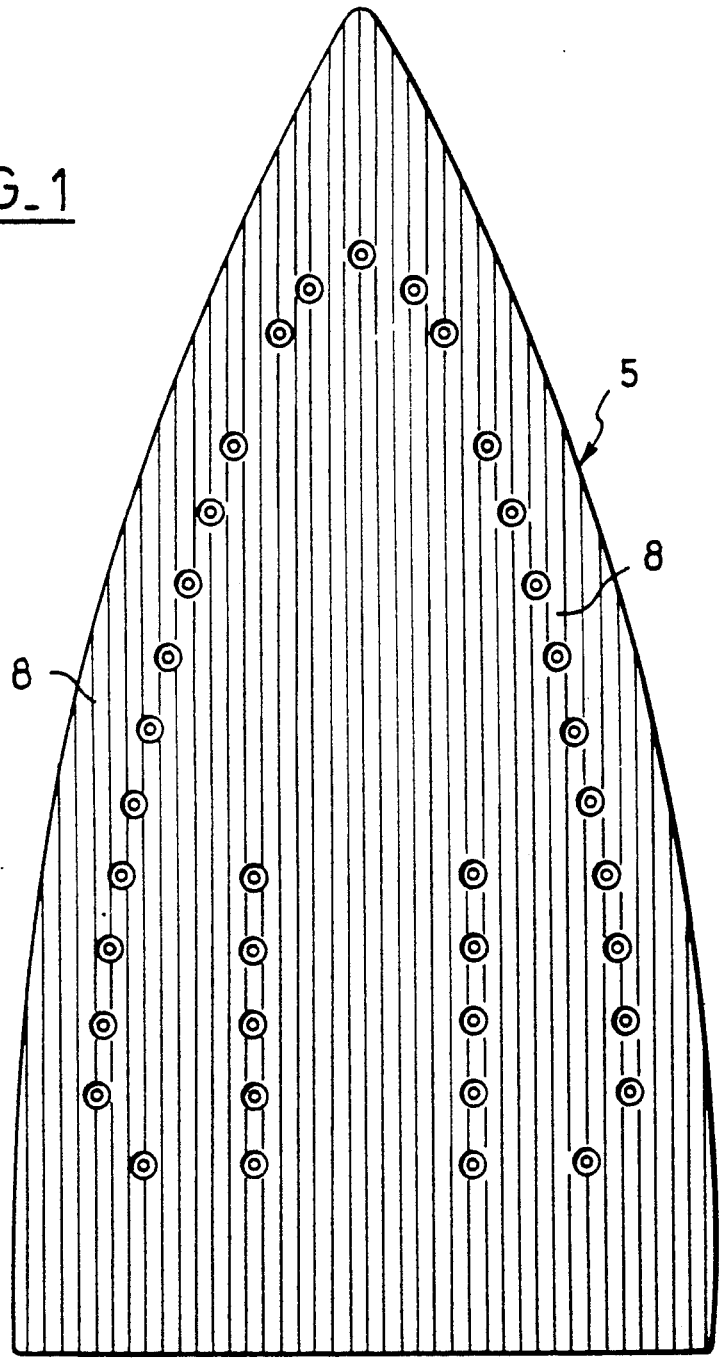
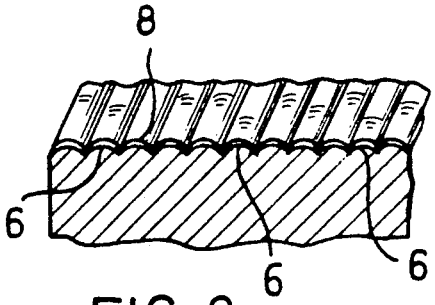
FIG_2
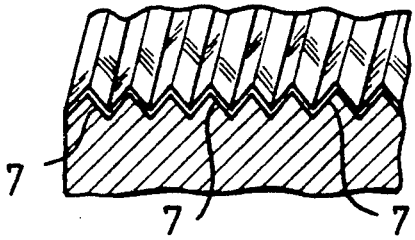
FIG_3

IRONING DEVICE SOLE-PLATE WITH COATED RIBS

BACKGROUND OF THE INVENTION

1. Field of the Invention

The present invention relates to a laundry iron having a metallic sole-plate provided with an anti-adhesive coating.

2. Description of the Related Art

Sole-plates of laundry irons are usually of aluminum. The sole-plate face which is intended to come into contact with the articles to be ironed is polished in order to reduce the coefficient of friction with the articles to be ironed and thus to facilitate the ironing operation.

However, this polished surface is sensitive to stains which are difficult to clean and distinctly increase the coefficient of friction.

In order to overcome this disadvantage, the present Applicant has proposed to cover the surface of laundry-iron sole-plates with an enamel coating. This coating makes it easier to clean the surface of the sole-plate and improves the coefficient of friction, that is to say the "glide" of the iron.

However, enamel coatings are relatively sensitive to mechanical impacts. Chips formed in the enamel in the event of impact affect the coefficient of friction and consequently the glide of the iron.

Consideration has already been given to the possibility of coating the sole-plates of irons with a layer of anti-adhesive material based on fluorocarbon resin such as polytetrafluoroethylene.

However, a coating of this type has poor resistance to abrasion and the friction of the sole-plate on the articles to be ironed, in particular on hard portions such as buttons, zippers and the like causes rapid wear of the coating.

SUMMARY OF THE INVENTION

The object of the present invention is to overcome the disadvantages of the known designs by so shaping the surface of laundry-iron sole-plates that this surface not only has a distinctly lower coefficient of friction with the articles to be ironed but also has distinctly higher abrasion resistance.

In accordance with the invention, the laundry iron includes a metallic sole-plate distinguished by the fact that the sole-plate surface which is intended to come into contact with the articles to be ironed has a series of projections formed in the surface of the metallic sole-plate, this surface being covered with a continuous anti-adhesive coating having a base of fluorocarbon resin or of enamel which follows the profile of the projections.

In this case, the projections are first formed by machining or die-stamping on the surface of the metallic sole-plate, whereupon the coating having a base of fluorocarbon resin or of enamel is applied on the entire surface of the sole-plate.

These projections coated with fluorocarbon resin or enamel reduce the contact surface between the sole-plate and the surface of articles to be ironed, with the result that the "glide" of the sole-plate is distinctly improved with respect to a continuous, flat and smooth coating.

Moreover, the abrasion resistance is also improved.

This result can be explained by the fact that the hard and fine particles which are liable to penetrate between the sole-plate surface and the textile fabric to be ironed tend to slide within the spaces located between these projections, with the result that the fluorocarbon resin or the enamel which forms a coating on the projections is less exposed to the effects of abrasion.

Thus the enhanced glide obtained in accordance with the invention is maintained over a long period of use of the iron.

In accordance with the invention, the projections can be formed by a series of substantially parallel ribs extending in the longitudinal direction of the sole-plate.

Further distinctive features and advantages of the invention will become apparent from the description which now follows.

BRIEF DESCRIPTION OF THE DRAWINGS

FIG. 1 is a plan view of one embodiment of the laundry-iron sole-plate in accordance with the invention.

FIG. 2 is a partial view in perspective and in cross-section of the sole-plate shown in FIG. 1.

FIG. 3 is a view similar to FIG. 2 and showing an alternative embodiment.

DETAILED DESCRIPTION OF THE PREFERRED EMBODIMENTS

In the embodiment illustrated in FIGS. 1 to 3, the sole-plate 5 formed of aluminum is provided on the surface which is intended to come into contact with the articles to be ironed with a series of parallel ribs 6, 7 extending in the longitudinal direction of the sole-plate.

Said ribs 6, 7 are formed in the metal of the sole-plate 5.

In the case of FIG. 2, the ribs 6 each have a rounded crest and can be formed by die-stamping.

In the case of FIG. 3, the ribs 7 have a pointed crest and can be formed by machining.

In both cases, the ribs 6, 7 and the entire surface of the sole-plate 5 (aside from the steam outlets) are coated with a continuous layer 8 of fluorocarbon resin such as polytetrafluoroethylene or of enamel.

The width and the height of the ribs 6, 7 can be within the range of a few tenths of a millimeter to a few millimeters.

The thickness of the fluorocarbon resin or enamel coating can vary between 2 and 50 μm.

When ironing is in progress, only the crests of the ribs which are coated with fluorocarbon resin or with enamel come into contact with the articles being ironed. This reduced contact surface makes it possible to improve the "glide" of the iron as shown by the results indicated in the following table.

| Nature of textile fabric | Friction force | | |
|---|---|---|---|
| | Sole-plate of bare aluminum | Sole-plate of aluminum coated with PTFE | Ribbed aluminum sole-plate coated with PTFE |
| Polyester | 350 g | 250 g | 150 g |
| Twill-weave cotton fabric | 360 g | 260 g | 170 g |

Moreover, the fluorocarbon resin coating has good abrasion resistance and good adhesion to the ribbed surface of the sole-plate.

Instead of being coated with fluorocarbon resin, the sole-plate in accordance with the invention can be provided with an enamel coating. The composition and the method of application of the enamel can be as described in French patent Application No. 89 00251 of Jan. 11th, 1989 filed in the name of the present Applicant.

What is claimed is:

1. A smoothing or pressing or steam iron having a metallic sole-plate that comes into contact with articles to be ironed and has a series of substantially parallel ribs (6, 7) whose width and height are within the range of a few tenths of a millimeter to a few millimeters, said sole-plate having an exposed surface having a continuous anti-adhesive coating (8) selected from the group consisting of fluorocarbon resin and enamel, said coating following and maintaining the profile of said ribs.

2. The iron according to claim 1, wherein the ribs (6, 7) extend in a longitudinal direction of the sole-plate.

3. The iron according to claim 2, wherein each rib (6) has a rounded crest.

4. The iron according to claim 2, wherein each rib (7) has a pointed crest.

* * * * *